US005184497A

United States Patent [19]

Hanlon et al.

[11] Patent Number: 5,184,497

[45] Date of Patent: Feb. 9, 1993

[54] MAGAZINE FOR AUTOMATIC FEED BLIND RIVET SETTING TOOL

[75] Inventors: Daniel Hanlon; Stuart J. Sandhaus, both of Pittsburgh, Pa.; James L. Hopkins, Venice, Fla.

[73] Assignee: S.A.R.G. Research Associates, Ltd., Sarasota, Fla.

[21] Appl. No.: 920,037

[22] Filed: Jul. 27, 1992

Related U.S. Application Data

[63] Continuation-in-part of Ser. No. 792,011, Nov. 13, 1991, Pat. No. 5,136,873.

[51] Int. Cl.[5] ..... B21J 15/32

[52] U.S. Cl. ..... 72/391.6; 29/243.521; 29/243.526

[58] Field of Search ..... 72/391.6; 29/243.521, 29/243.526

[56] References Cited

U.S. PATENT DOCUMENTS

| | | | |
|---|---|---|---|
| 2,495,070 | 1/1950 | Mellodge | 72/391.6 |
| 3,733,882 | 5/1973 | Klein | 72/391.6 |
| 3,886,783 | 6/1975 | Hirsch | 72/391.6 |
| 3,979,039 | 9/1976 | David | 227/60 |
| 4,089,099 | 5/1978 | Nivet | 72/391.6 |
| 4,131,004 | 12/1978 | Hara et al. | 72/391.6 |
| 4,744,238 | 5/1988 | Halbert | 72/391.6 |

*Primary Examiner*—David Jones
*Attorney, Agent, or Firm*—Charles J. Prescott

[57] ABSTRACT

A magazine for compactly holding and feeding therefrom a quantity of blind rivets to a specially configured rivet table of a blind rivet setting device. The magazine, as part of an automatic rivet feed mechanism, contains a thin elongated strip or ribbon of flexible material holding the mandrel tips pierced through the strip evenly spaced apart. The strip is drawn from the magazine through a transverse feed slot formed through the rivet table generally orthogonal to the longitudinal axis of the device. A spring biased retracting device continuously pulls the strip through the feed slot so that the next rivet in succession facing the rivet table is automatically drawn into axial alignment within the rivet table ready for positioning and setting into a work surface.

10 Claims, 7 Drawing Sheets

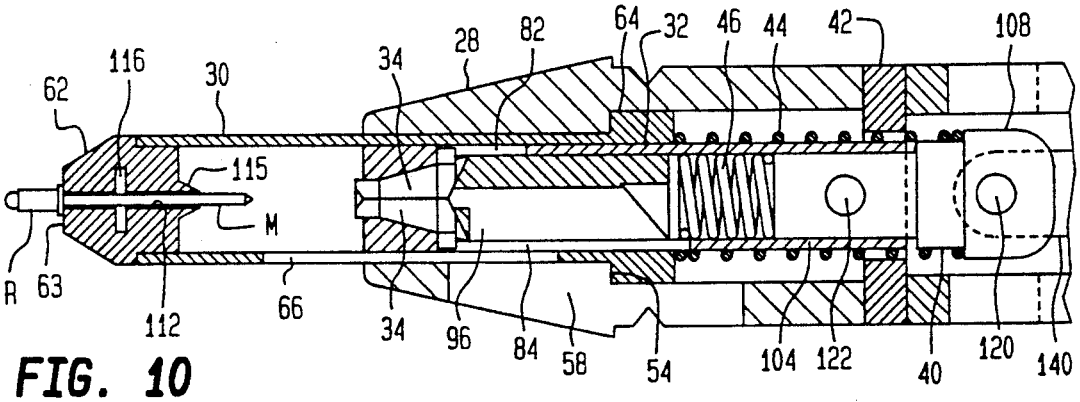
FIG. 10
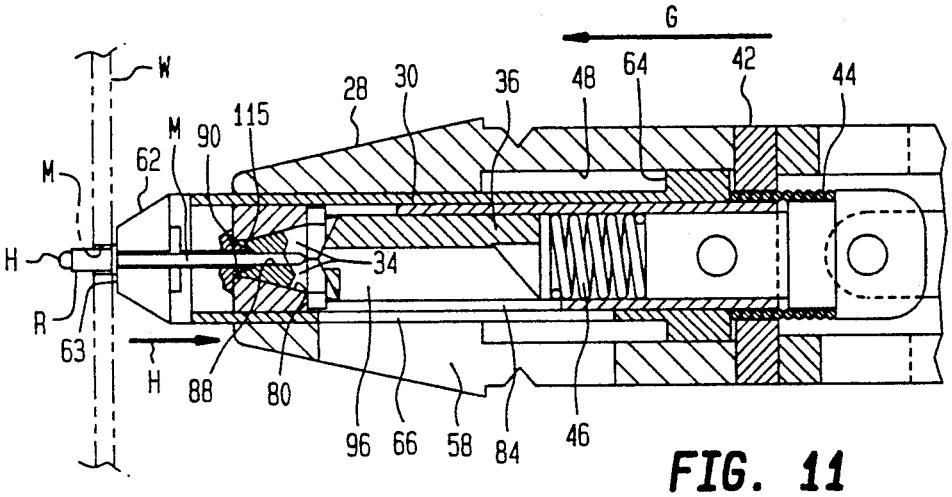
FIG. 11
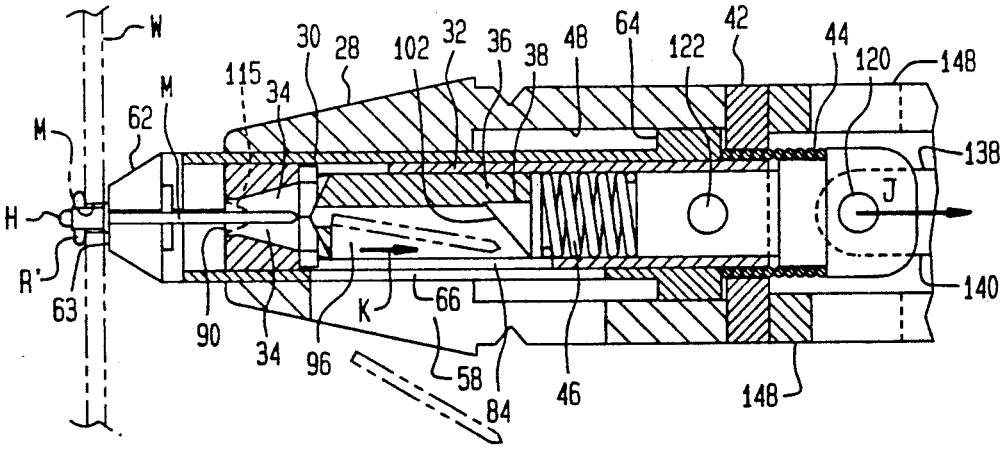
FIG. 12
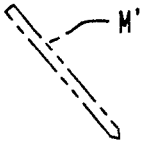

MAGAZINE FOR AUTOMATIC FEED BLIND RIVET SETTING TOOL

BACKGROUND OF THE INVENTION

This is a continuation in part of Ser. No. 07/792,011 filed Nov. 13, 1991 to be issued Aug. 11, 1992 as U.S. Pat. No. 5,136,873.

This invention relates generally to automatic riveting devices, and more particularly to a magazine for a feed blind or pop riveting device having an automatic rivet feed means.

Considerable technological effort has been expended in developing blind or pop or mandrel-type rivets, hereinafter collectively referred to as blind rivets, and the associated manually operated devices for setting such rivets. The primary requirement for setting blind rivets is to support the enlarged flange of the rivet body against an anvil or rivet table with the rivet body inserted through a closely mating hole in a work surface. The mandrel extends axially through the rivet table and is gripped by jaws which tension and pull the mandrel rearwardly, expanding the body of the rivet to a point where the mandrel is fractured away. Thus, blind rivets are particularly useful in situations where a conventional riveting tool does not have access to both sides of the working surfaces to be rivet-connected together.

What appears to be a second stage in the development of blind rivets has been toward the automatic setting of the rivet wherein a source of power such as a motor, a pneumatic actuator, or hydraulics, are utilized to replace manual effort in expanding and setting the rivet through mandrel pull.

This riveting technology has also expanded into the development of automatic riveting devices which include an automatic feed means for the rivets themselves. Prior to such development, the user has been required to manually insert each fresh rivet into the rivet table, one at a time. Because these devices still require the user to depress an actuator or trigger to set each rivet, these devices are referred to as "semiautomatic" rivet machines having an automatic feed.

The bulk of these automatic feed rivet devices fall generally into two categories. The first category is one wherein the nosepiece and/or rivet table is pivotally or arcuately connected wherein these components swing apart radially outwardly from one another so that a new rivet may be passed forward longitudinally from behind this arrangement into position, whereupon the nosepiece and/or rivet table components are closed around the rivet body and mandrel with the flange of the rivet against the distal end surface of the rivet table.

The second general category of automatic rivet feed means is directed to an external arm arrangement which swings or pivots a fresh rivet into coaxial alignment forwardly of the rivet anvil and then either automatically draws or allows the rivet to be manually moved rearwardly wherein the mandrel enters the longitudinal aperture of the rivet anvil.

Despite this considerable effort and incentive in developing such an automatic feed rivet machine, nonetheless no such devices known to applicants have been marketed successfully to date. Proper and reliable functioning appears to be a shortcoming of all known prior art devices. Obviously, the market for such a device is extensive, reaching from space station deployment, through both light and heavy industry and aircraft assembly, all the way to the home enthusiast. In each case, the need for a high volume rate of setting blind rivets is the desired end result which has, to date, remained unsatisfied.

The present invention provides a feed magazine for compactly holding a large quantity of blind rivets for such a device which in prototype and preproduction form has operated successfully and reliably to date. This invention offers fully automatic rivet magazine feed means for an accompanying riveter which will set rivets automatically as quickly as an operator can act to position each new rivet into another hole in the work surface and activate the riveter.

BRIEF SUMMARY OF THE INVENTION

This invention is directed to a magazine for compactly holding and feeding therefrom a quantity of blind rivets to a blind rivet setting device which automatically feeds blind rivets into a specially designed rivet table, then sets the rivet by pulling and detaching the mandrel. The magazine as part of the rivet feed mechanism holds a thin elongated strip or ribbon of flexible material holding the mandrel tips pierced through the strip and evenly spaced apart. The strip, spiral wound within the magazine, is drawn from the magazine into a feed slot formed transversely through the rivet table generally orthogonal to the longitudinal axis of the riveter. A spring biased retracting device continuously pulls the strip through the feed slot so that the next rivet in succession facing the rivet table is automatically drawn into axial alignment within the rivet table ready for positioning and setting into a work surface.

It is therefore an object of this invention to provide a magazine for retaining a quantity of rivets for automatic feed into a fully operational, functional and reliable automatic riveting device for setting blind rivets which includes an automatic rivet feed arrangement.

It is therefore an object of this invention to provide a magazine for retaining a quantity of rivets for automatic feed into a rivet setting device having a specially designed rivet table for use in conjunction with an automatic rivet feed arrangement.

It is still another object of this invention to provide a magazine for holding a quantity of rivets as part of an automatic blind rivet feed arrangement for riveting devices.

In accordance with these and other objects which will become apparent hereinafter, the instant invention will now be described with reference to the accompanying drawings.

BRIEF DESCRIPTION OF THE DRAWINGS

FIG. 10 is an enlarged view of FIG. 3 showing a blind rivet in position within the head of the riveter assembly ready for placement into a suitable prepared hole in a work surface.

FIG. 11 is a view similar to FIG. 10 except that the rivet has been inserted into the prepared hole and the nose section has been manually compressively retracted to place the mandrel within the jaws.

FIG. 12 is a view similar to FIG. 11 except that the rivet has been expanded and set into the work surface and depicting in phantom the ejection of the spent mandrel.

DETAILED DESCRIPTION OF THE INVENTION

Figures 1, 2, 3:
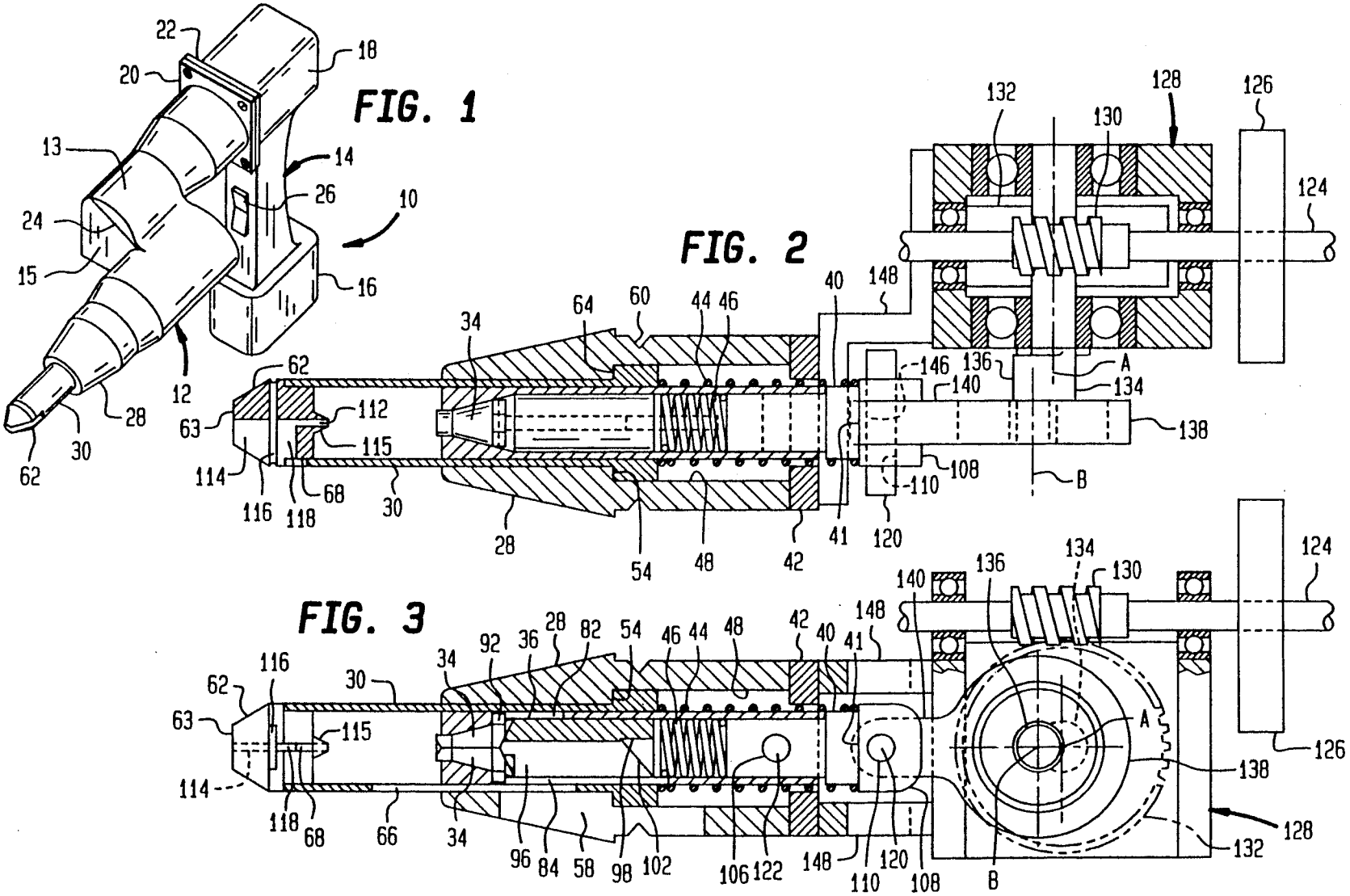
FIG. 1 is a perspective view of an automatic blind riveter assembly.
FIG. 2 is a top plan section view of the riveter assembly as shown in FIG. 1 absent the protective enclosure and battery/motor pack.
FIG. 3 is a side elevation section view of FIG. 2.
Figure 4:
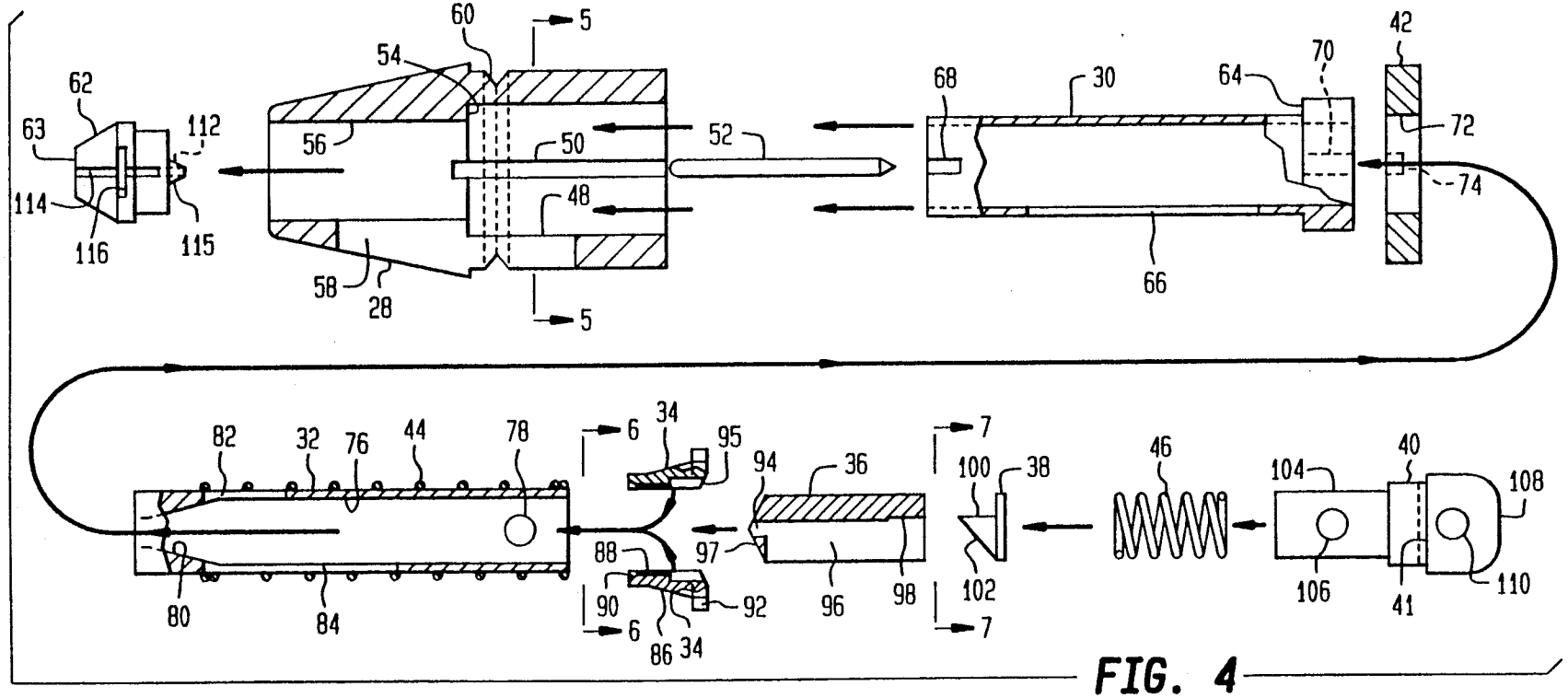
FIG. 4 is an exploded side elevation partial section view of the components comprising the working head of the riveter assembly detached from the worm gear and eccentric drive.
Figure 7:
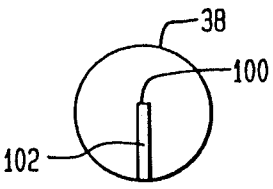
FIG. 7 is a view in the direction of arrows 7—7 in FIG. 4.
Figure 6:
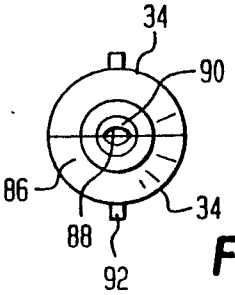
FIG. 6 is a view in the direction of arrows 6—6 in FIG. 4.
Figure 5:
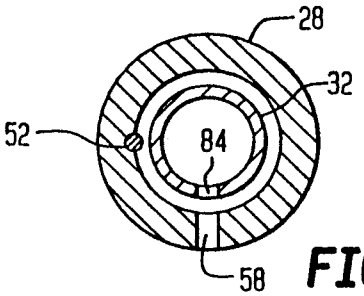
FIG. 5 is a section view in the direction of arrows 5—5 in FIG. 4.

Referring now to the drawings, and particularly to FIG. 1, the preferred embodiment of an automatic blind riveter assembly is shown generally at numeral 10 and generally includes a main rivet setting portion or head 12 and a motor/battery pack 14, both of which include and are bolted together by mounting flanges 20 and 22, respectively. The head 12 includes an outer molded thin plastic housing formed of two housing halves 13 and 15 which mate along parting line 24. A machined aluminum nose section 28 extends forwardly from the housing halves 13 and 15 as will be described herebelow. An outer sleeve 30 having a rivet table 62 secured in the distal end thereof forms the forwardly portion of the head 12.

The motor/battery pack 14 includes a conventional low voltage d.c. motor 18 which is operably connected by trigger 26 to a rechargeable battery 16 and also serves as a handle.

Note that head 12 is shown rotatedly offset from a vertical plane passing through the center of motor/battery pack 14, but is not a required feature, the center line of all components otherwise conveniently lying in the same vertical plane.

Referring additionally to FIGS. 2 to 7, the rivet setting components of the head 12 absent the housing halves 13 and 15 of the automatic riveter assembly 10 are there shown. A nosepiece 28 formed of machined aluminum includes a forwardly tapered outer surface and a cylindrical rearwardly portion which lockably engages by groove 60 within mating retaining heads (not shown) in the two part molded housing 13/15. A tubular outer sleeve 30 slidably engages within bore 56 for fore-and-aft longitudinal movement and supportively receives a rivet table 62 within its forwardly end. The enlarged stop 64 at the rearwardly end of outer sleeve 30 contacts against surface 54 when in a forwardly at-rest position, slidably engaging along bore 48 back and forth as will be described herebelow. Pin 52 matably engages within a cylindrical hole formed radially evenly spaced between bore 48 and stop 64 to prevent rotation between outer sleeve 30 and nose section 28, the rearwardly end of pin 52 fitting within pocket 74 of stop plate 42.

A tubular inner sleeve 32 slidably engages within outer sleeve 30 and is structured by its tapered forwardly inner end 80 to matably support and guide a two part set of jaws 34. Jaws 34 include a truncated conical shaped outer surface 86 along their main mid portion which slidably engage against surface 80 and also include a tapered forwardly inner surface 90 leading to a serrated or toothed section 88, and guide tabs 92. These guide flanges 92 slidably engage within longitudinal slots 82 and 84 opposingly formed through the wall of inner sleeve 32.

A cylindrical jaw spreader 36 slidably engages within cylindrical surface 76 of inner sleeve 32. This jaw spreader 36 includes a wedge-shaped forwardly surface 97 having a central longitudinal mandrel receiving aperture 94 formed therethrough. This conical or wedge-shaped surface 97 matably engages against rear surfaces 95 of jaws 34 and, when forwardly biased by spring 46 which acts to urge jaw spreader 36 axially forward, serves to both forwardly bias and spread jaws 34 apart so as to maintain guide tabs 92 within their respective slots 82 and 84.

Jaw spreader 34 also includes mandrel slot 96 which is longitudinally formed and radially extending from the approximate center line of jaw spreader 36.

A mandrel ejecting plate 38 is also provided which slidably mates for fore-and-aft movement within the rearward end of jaw spreader 36 such that edge 100 is closely mated against notch 98 to prevent rotation thereof. A mandrel deflecting surface 102 is formed by blade 100 to function to deflect the spent or broken mandrel from the device as will be described herebelow. Compression spring 46 acts against the rearward surface of ejecting plate 38 so as to urge jaw spreader 36 forwardly.

To complete this head 12 (absent housing) as a subassembly, a clevis 40 matably engages within inner surface 76 of inner sleeve 32 and is secured there by transverse pin 122 fitted within aligned transverse holes 78 and 106, respectively. The forwardly end of clevis 40 thus acts against the rearwardly end of spring 46 to compress same as previously described.

A compression spring 44 which slidably engages over inner sleeve 32 acts at its rearwardly end against surface 41 of clevis 40 and, at its forwardly end, against the rear surface of stop 64. This arrangement is maintained and partially controlled by the secured positioning and eccentric movement of a connecting rod 138 acting through connecting pin 120 aligned through mating holes 110 in clevis 40 and 146 in the forwardly end 140 of connecting rod 138.

From the above, it should now be understood that outer sleeve 30 is movable axially fore and aft within nose section 28 against spring 44 between a forwardly at-rest position wherein stop 64 acts against surface 54 and a rearwardly position wherein stop 64 acts against stop plate 42. Similarly, the axially fore and aft positioning of inner sleeve 32 is controlled by the fore and aft movement of clevis 40 which, in turn, is controlled by driven eccentric rotation of connecting rod 138 about axis A as will be described herebelow. Clevis 40, acting against spring 46, urges jaw spreader 36 forwardly against the rearward surfaces 95 of jaws 34 so as to maintain the jaws in the forwardly at-rest position as shown in FIGS. 2 and 3.

The drive transmission arrangement is best seen in FIGS. 2 and 3 and includes a gear housing 128 within which is mounted a worm wheel 132 secured to crank shaft 134. Worm gear 130 is connected to drive shaft 124 which, when rotatably driven by motor 18, causes worm wheel 132 and crank shaft 134 to rotate about axis A. Connecting rod 138 is rotatably connected to offset shaft 136 of connecting rod 34 about axis B so that the offset between axis A and axis B produces the eccentric driving movement of connecting rod 138.

To enhance the mandrel pulling capacity of this drive train, a fly wheel 126 is connected to drive shaft 124 to provide additional inertia for breaking the mandrel as will be described herebelow.

Gear housing 128 is connected to stop plate 42 by brackets 148 which are spaced apart to allow clearance for the movement of clevis 40 and spring 44 therearound.

Figures 8, 9:
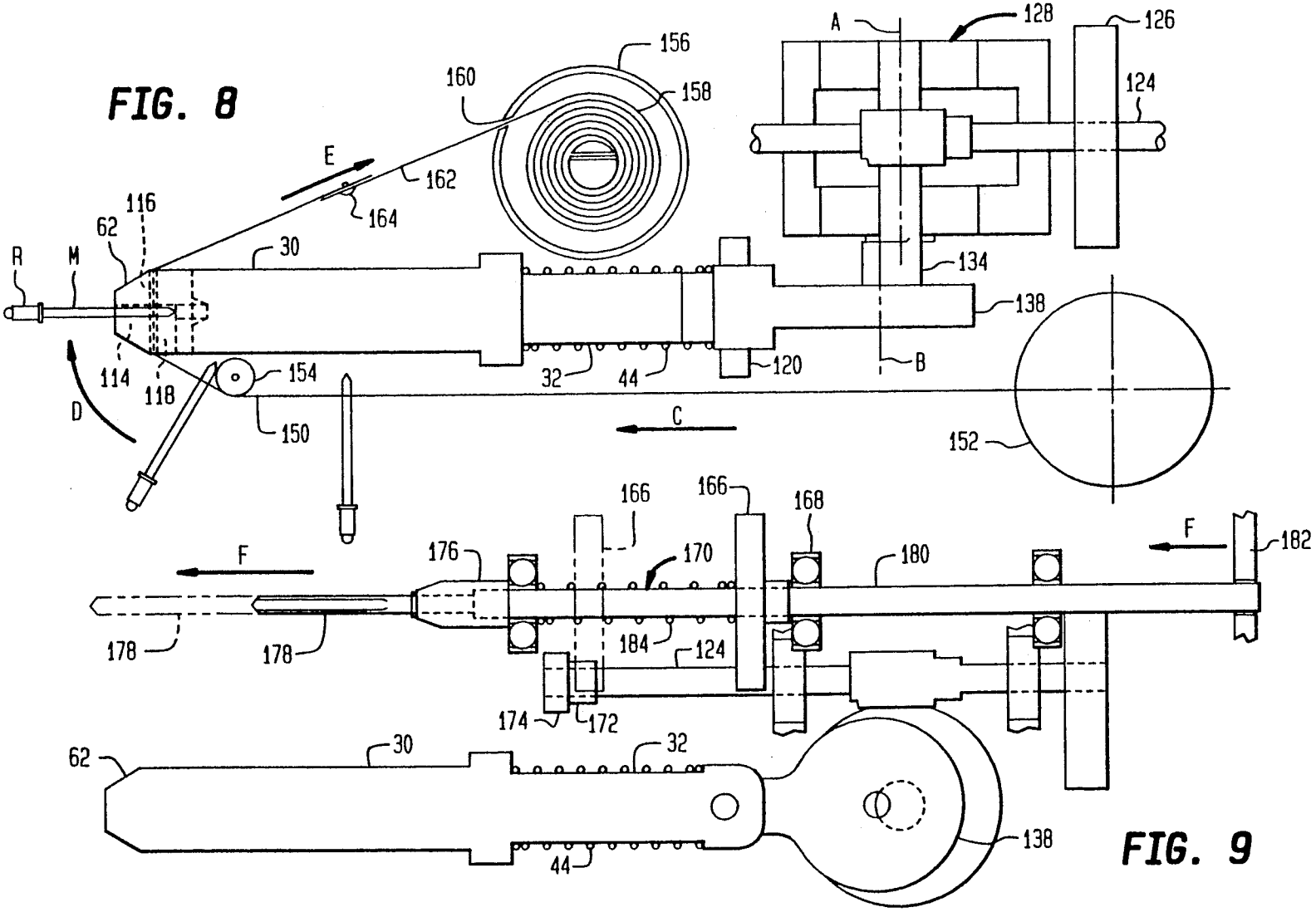
FIG. 8 is a top plan schematic view of the riveter assembly and depicting the automatic rivet feed arrangement with respect thereto.
FIG. 9 is a side elevation schematic view of the riveter assembly depicting an auxiliary movable drill accessory.

Referring now to FIG. 8, a rivet feed mechanism is there shown schematically. Rivet table 62 as also most clearly shown in FIGS. 2 and 10, includes a transverse slot 116 and coplaner radially extending longitudinal slots 114 and 118. A longitudinal slot 68 is also formed in the forward end of outer tube 30 which aligns with longitudinal slot 118.

Figure 13:
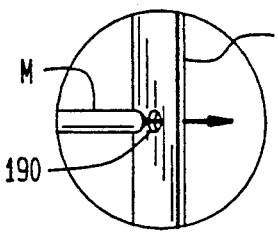
FIG. 13 is an enlarged view depicting insertion of the mandrel of a blind rivet into the flexible feed strip.

The blind rivets R are held within a thin MYLAR, nylon or plastic strip 150 by inserting the distal tip portion of each mandrel M partially therethrough as best seen in FIG. 13. The MYLAR strip 150 is of sufficient strength so that, when the tips of the mandrels M are pierced or heat formed therethrough, they are securely retained until drawn into the rivet table 62 and set by the rivet device as will be described herebelow.

The MYLAR strip 150 and rivets R held therein are stored within container or magazine 152 and fed forwardly therefrom in the direction of arrow C around roller 154. The free end of MYLAR strip 150 is fed transversely through slot 116 in the direction of arrow D and pulled in the direction of arrow E until the first mandrel M of the first rivet R enters into coaxial alignment within mandrel aperture 112. The MYLAR strip 150 is connected by pin 164 to the distal end 162 of spiral-wound retracting spring 158 of retractor 156. The retracting spring 162 feeds into and out of retractor housing 156 through slot 160.

By this arrangement shown in FIG. 8, the rivets R are sequentially and automatically brought into coaxial alignment within rivet table 62 each time the mandrel M is fractured from rivet R as it is set within a work surface. This setting action also tears the rivet R from the mylar strip 150 as the rivet R is set. Note that the lengths of slots 68 and 118 establish the length of the mandrel tip portion extending through the MYLAR strip 150 and may easily be varied as desired.

Referring now to FIG. 9, an accessory drill attachment is there shown schematically at numeral 170. This drill accessory 170 includes a secondary drive shaft 180 which is rotatably driven by gear 166 which engages gear 172 on drive shaft 124 when moved forwardly into the position shown in phantom. An additional bearing 174 is provided to support the distal end of drive shaft 124.

Auxiliary drive shaft 180 is supported within bearings 168 for axial longitudinal forward translation in the direction of arrow F. This movement is effected by manual manipulation of handle 182. Thus, when auxiliary drive shaft 180 is fully forward, drill chuck 176 and drill bit 178 secured therewithin begin to rotate by the driving interaction between gears 172 and 166. When in the drivingly engaged position, drill bit 178 in phantom extends beyond the rivet anvil 162 for work surface engagement. Spring 184 maintains the arrangement rearwardly in an at-rest position.

SEQUENCE OF OPERATION

Referring now to FIGS. 10, 11 and 12, the sequence of operation of rivet setting is there depicted. In FIG. 10, the rivet R is shown within rivet anvil 62 with mandrel M fully inserted through longitudinal aperture 112. In this position, the head of rivet R is also fully engaged against the distal transverse surface 63 of rivet table 62.

To commence the rivet setting operation, the rivet R is inserted into a prepared hole M in a work surface W. By manual movement of the nosepiece 58 in the direction of arrow G, the outer sleeve 30 is forcibly retracted in the direction of arrow H, thus compressing spring 44. This retraction terminates when stop 64 contacts stop plate 42.

When in the position shown in FIG. 11, the mandrel M becomes inserted within jaws 34 as shown. The teeth or serrations 88 will then grip against and retain the mandrel M, assisted by the forwardly biasing of jaw spreader 36 by spring 46 as previously described. The conical tapered outer surfaces 86 of jaws 34, when urged forwardly in this manner, will cause the serrations 88 to tightly dig into and grip mandrel M, thus preventing the outer sleeve 30 from extending forwardly back to its at-rest position shown in FIG. 10.

In FIG. 12, the motor 18, (FIG. 1) is activated and the shank 140 with connecting rod 138 is eccentrically drawn rearwardly in the direction of arrow J by the worm gear arrangement previously described. The "throw" of the eccentric drive shaft 134, i.e. twice the distance between axis A and axis B shown in FIGS. 2 and 3, may be chosen to be in excess of the anticipated pull required to set rivet R and to fracture the mandrel M therefrom. However, typically this "throw" per each revolution of the crankshaft 134 will be somewhat less than that amount. Therefore, several revolutions of crankshaft 134 will be required to pull and fully set the rivet into the configuration R' and to fracture the mandrel M therefrom.

As a consequence of the repeated number of revolutions required to fully set each rivet R' and fracture the mandrel M therefrom, the jaws 34 must be repeatedly disengaged from the mandrel M and then be reclamped therearound, each time successively closer to the rivet R for each cycle. To help accomplish this, a rearward conical extension 115 of rivet table 62 is configured so as to slightly contact the jaws 34 within surface 90 so as to very slightly urge the jaws 34 rearwardly from their forwardly most position. This movement is in the range of 0.001" to 0.010" when the inner sleeve 32 is in its forwardly, at-rest position. Thus, in FIG. 12, with each revolution of crank shaft 134 and the rearward movement of pin 120 in the direction of arrow J, jaws 34 are urged to their forwardly most position by jaw spreader 36 and are then slightly urged rearwardly by rivet table extension 115 when the inner tube 32 returns to its fully forward, at-rest position. By this arrangement, then the repeated release of the grip of jaws 34 around mandrel M followed by a secure reengagement therearound is effected.

It has been found that this slight rearward urging of the jaws 34 as inner tube 32 returns to its fully forward, at-rest position is an important feature of the present invention in that the jaws 34 may not otherwise easily release their grip around mandrel M so as to allow for a fresh grip therearound closer to the head of the rivet R.

When the head 12 of mandrel M has been pulled sufficiently rearwardly with respect to rivet R and the work surface W, and the enlarged head H of mandrel M has sufficiently mushroomed or expanded rivet R into the configuration R', the mandrel M will then fracture or break away from head 12. To clear the spent mandrel M', four separate slots, 96 and jaw spreader 36, 84 in inner sleeve 32, 66 in outer sleeve 30, and 58 in nose section 28 to allow the spent mandrel M' to discharge from the device as shown in phantom in FIG. 12.

To assist in the lateral deflection of the spent mandrel M', the diagonal surface 102 of ejection plate 38 comes into play. The rearward distal end of spent mandrel M' strikes surface 102 as it is propelled rearwardly in the direction of arrow K. Lateral and rotational deflection of the spent mandrel M' is thus commenced and effected as shown sequentially in phantom.

An additional feature of the ejection plate 38 may now be appreciated. Occasionally, a spent mandrel M' will jam within slot 96 of jaw spreader 36. To prevent this occurrence, spring 46 allows the ejection plate 38 to move rearwardly slightly, depending on the force exerted by the striking spent mandrel M'. This biased movement of ejection plate 38 has been shown to prevent jamming in this circumstance.

As previously noted, a flywheel 126 may be provided which will add a smoothing inertia force for setting larger rivets and fracturing the mandrel therefrom. Thus, once the motor has been energized for repeated gripping and rearward pulling of the mandrel, the flywheel 126 inertia adds to the pulling capacity of the motor/gear/eccentric arrangement.

Figure 14:
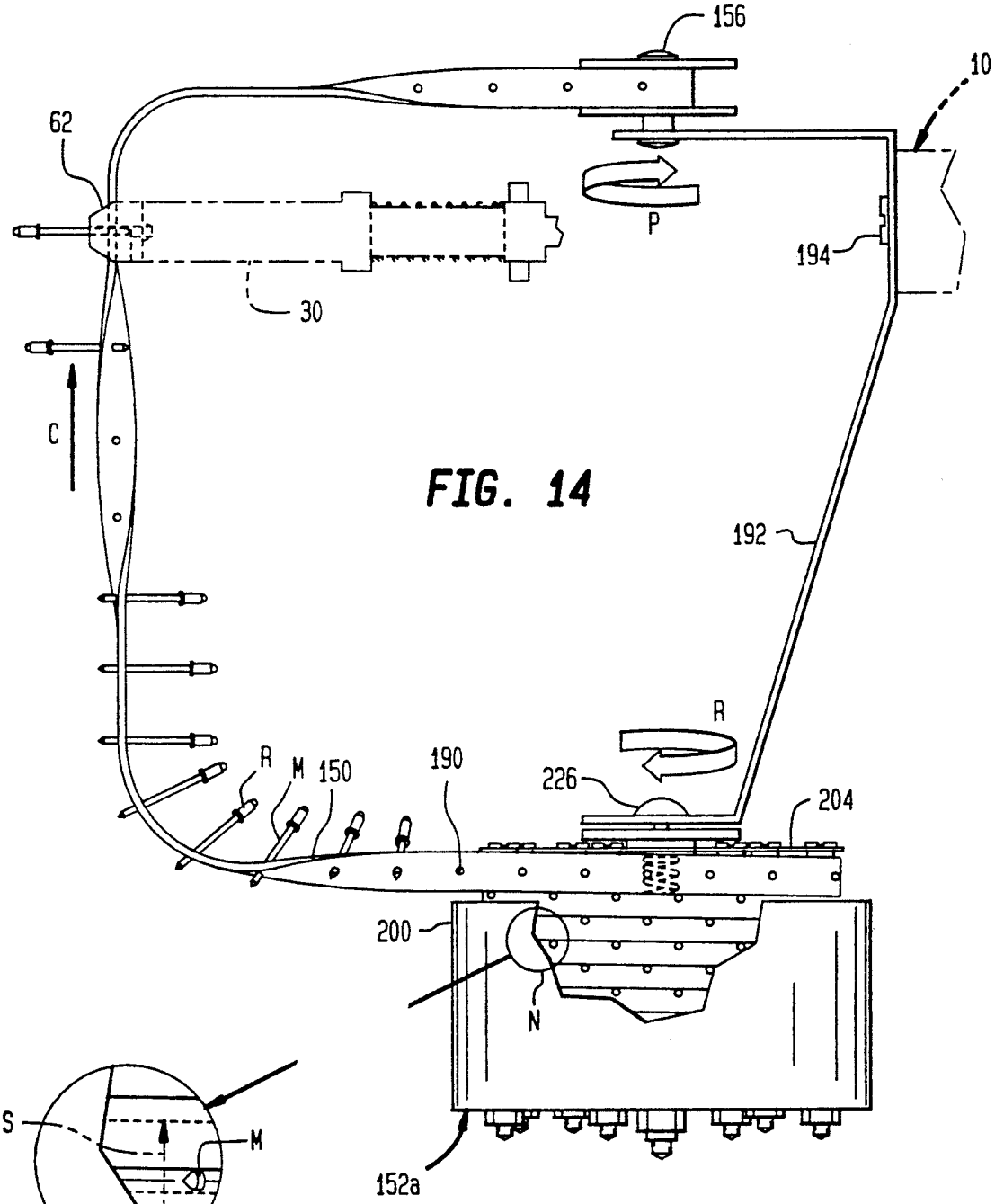
FIG. 14 is a top plan partially broken schematic view similar to FIG. 8 showing details of the preferred embodiment of the magazine.

Referring now to FIG. 14 to 18, the preferred embodiment of the magazine is shown generally at numeral 152*a* connected by a main threaded fastener 226 to a bracket 192 which is, in turn, connectable to the automatic riveter assembly 10 (shown in phantom) by fastener 194. As previously described, the retractor 156 is also connected to bracket 192 as shown in FIG. 14.

Figure 16:
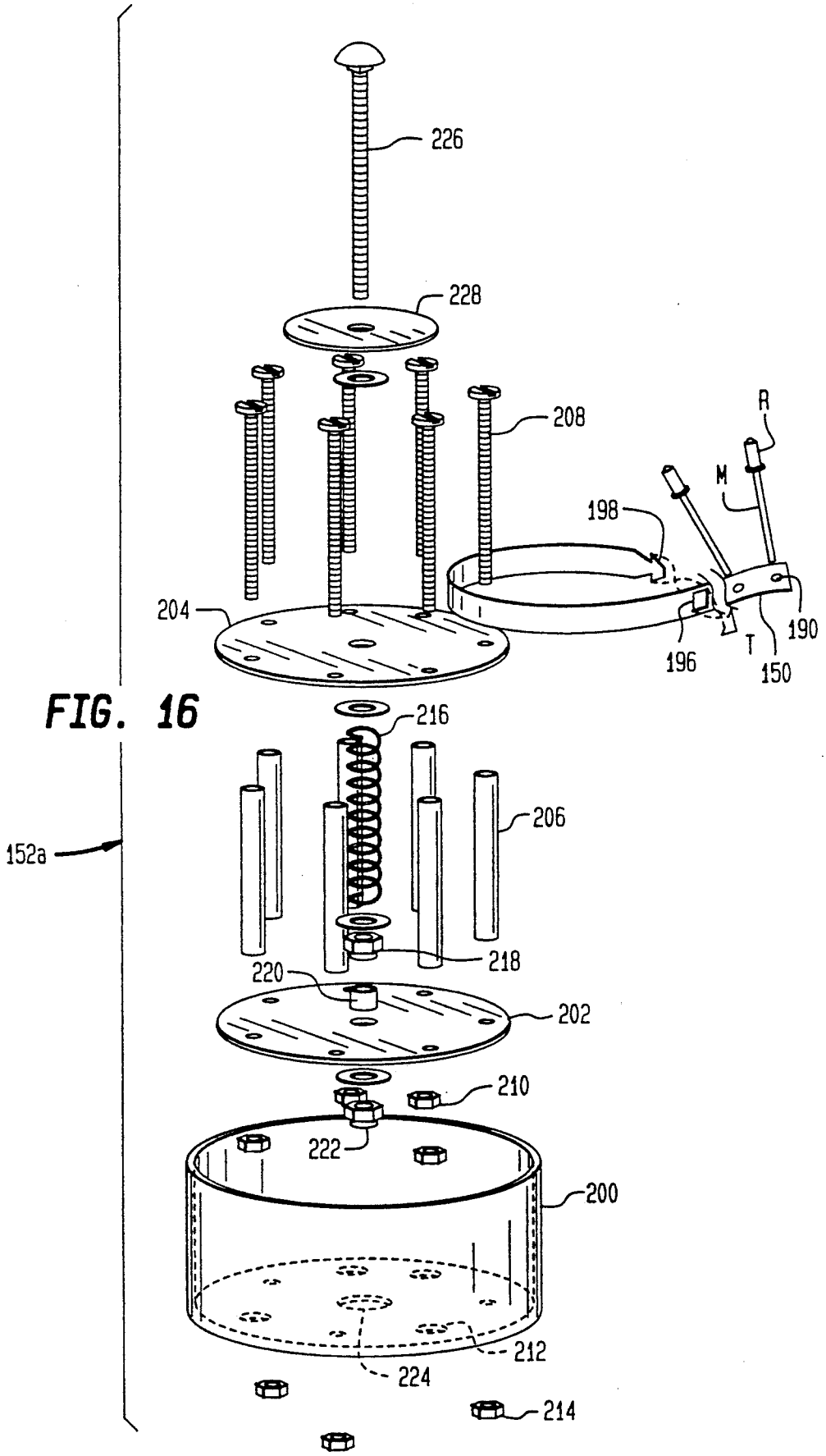
FIG. 16 is an exploded perspective view of the magazine shown in FIG. 14.
Figure 18:
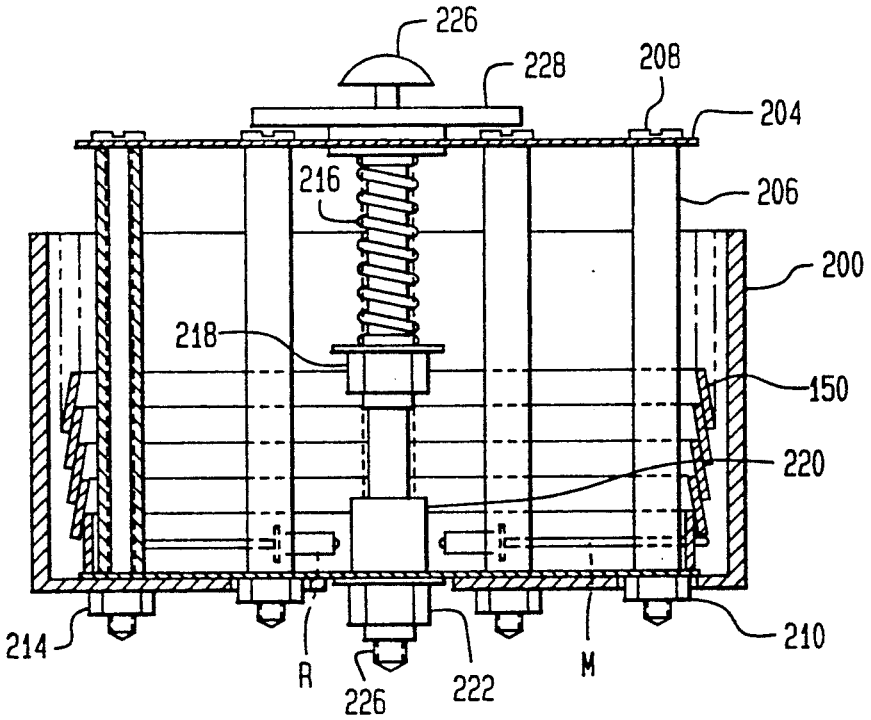
FIG. 18 is a section view in the direction of arrows 18—18 in FIG. 17.

The magazine 152*a* as best seen in FIGS. 16 and 18, includes a spool having a plurality of elongated spacer tubes 206 held by threaded bolts 208 evenly spaced about the central axis of circular inner and outer plates 202 and 204, respectively. Threaded nuts 210 retain this spool arrangement on the corresonding bolts 208 and nest within enlarged holes 212 formed into the bottom of a molded cup-shaped cover 200. Main nut 222, which threadably engages onto the end of main bolt 226, also nests within an enlarged hole 224 within cover 200. The spool is then removably held in position within cover 200 by nuts 214 which threadably engage onto the ends of the remaining corresponding bolts 208, thereby allowing removal of the cover 200 only by their removal.

A compression spring 216 is positioned over main bolt 226 between plates 202 and 204 and is made adjustable in biasing tension by nut 128, while threaded spacer 220, also engaged over main bolt 226, prevents axial movement of bolt 226 with respect to plates 202 and 204. By this arrangement, the entire magazine 152*a* is rotatable on mounting bracket 192 about main bolt 226, resistance to rotation variable by the appropriate adjustment of nut 218 by the friction interaction between friction disc 228 and outer plate 204.

Figure 15:
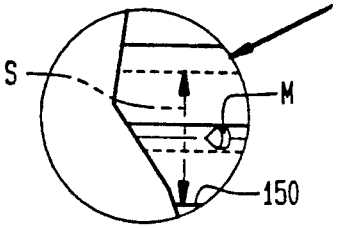
FIG. 15 is an enlarged view of region N in FIG. 14.
Figure 17:
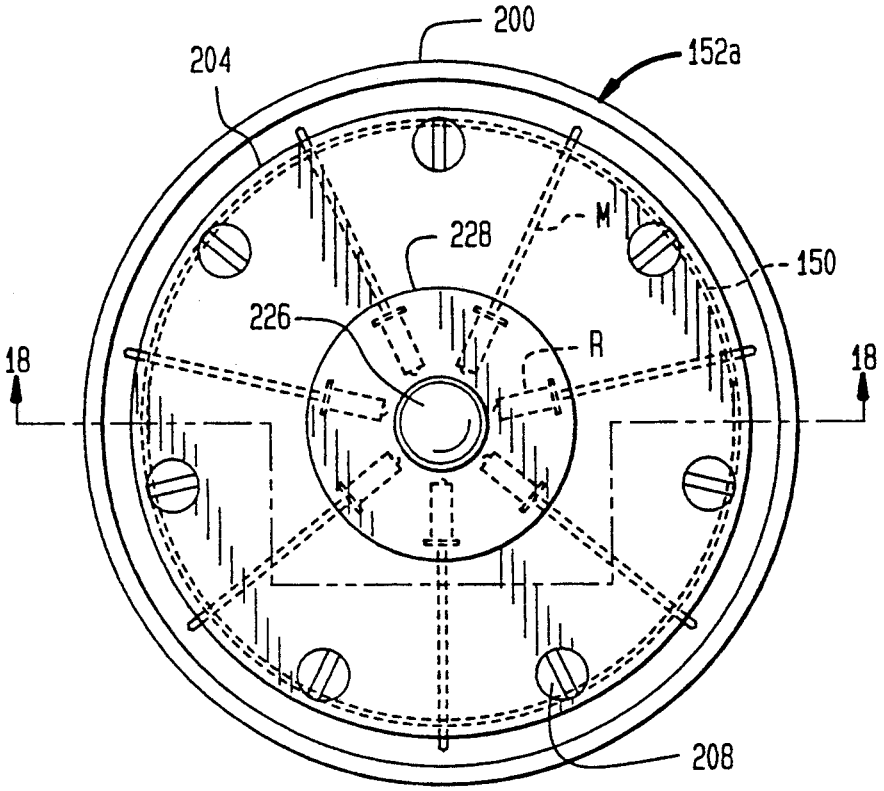
FIG. 17 is a top plan view of FIG. 16.

One end 198 of the flexible MYLAR strip 150 which carries the rivets R by piercing the mandrel M through holes 190 as previously described in FIG. 13 is formed so as to lockably engage in an aperture 196 therein in the direction of arrow T shown in FIG. 16. By this arrangement, this end of the flexible strip 150 may be releasibly secured around one of the elongated sleeves 206 to facilitate the spiral winding or loading of the flexible strip 150 carrying a quantity of rivets R secured therealong onto the spool so as to nest the rivets R as best seen in FIGS. 15, 17 and 18. By this spiral wound arrangement, the heads of the rivets R are positioned as best seen in FIG. 17, radially inwardly pointing and positioned immediately adjacent the central axis of the magazine 152*a*. Each mandrel M is positioned between two adjacent spacer tubes 206 so as to be radially outwardly pointing.

As may be now understood, a large quantity of rivets R may be contained ready for use within this magazine 152*a*. Spacer tubes 206 are sized in length so that outer disc 204 is spaced from the opening of cover 200 a distance generally equal to the width of the flexible MYLAR strip 150 so that the free end of the MYLAR strip may be fed into rivet table 62 of the rivet head 30 shown in phantom in FIG. 14 and then passed along into the retractor mechanism 156. Thus, the rivet capacity of the magazine may be easily varied by appropriate length selection of the spacer sleeves 206 and bolts 208.

By this arrangement, the flexible MYLAR strip 150 is freely extendable, limited by an adjustable friction setting of spring 216 by nut 218 as previously described so as to feed the rivets R into the rivet table 62 one at a time as previously described. The magazine 152*a* rotates about main bolt 226 in the direction of arrow R in FIG. 14, while the retractor mechanism 156 rotates in the direction of arrow P so as to both apply feed tension onto the MYLAR strip 150 and to rewind same onto its own compact spool for later reuse or disposal.

As best seen in FIG. 15, then, the spiral wound flexible strip 150 having a width S defines a spiral feed generally equal to half the width thereof so that the edge of the flexible strip 150 is positioned against the tip of each mandrel M pierced through the MYLAR strip 150.

It is here noted that cover 200 is preferred so as to protect this spiral wound arrangement and to prevent rivets R from inadvertently being dislodged from the flexible MYLAR strip 150 prior to use. However, the cover 200 is not an essential component thereof. Likewise, the preferred embodiment of the invention 152*a* is intended for use in conjunction with any rivet table uniquely structured to receive rivet feed from the MYLAR strip as hereinabove described and in conjunction with a automatic rivet setting tool. However, the structure of the nose piece hereinabove described may be readily adapted to a manual riveter and therefore the present invention is intended for use in conjunction with both manual and automatic riveters having a nosepiece structure similar to that hereinabove described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A magazine for holding a quantity of blind rivets ready for use in an automatic rivet setting tool, said quantity of rivets connected in spaced relation along the length of an elongated strip of thin flexible material by having a distal portion of each rivet inserted therethrough said magazine comprising:

a cover having a bottom and a continuous cylindrical side wall extending from said bottom to define a generally circular open end of said cover;

a plurality of parallel elongated spacer sleeves connected in evenly spaced arrangement between a pair of spaced parallel end plates forming a spool;

said spool removably connected concentrically within said cover and having a first end plate of said pair of end plates positioned immediately adjacent said bottom and a second end plate of said pair of end plates positioned beyond said opening forming a gap between said second end plate and said opening, said gap having a width generally at least equal to the width of said flexible strip;

said quantity of rivets carried on said flexible strip being generally radially positioned within said cover with each rivet mandrel of each rivet of said quantity of rivets between two adjacent spacer sleeves of said plurality of spacer sleeves, the head of each rivet being positioned inwardly toward and adjacent a central axis of said spool when said flexible strip is wound in spiral fashion around said plurality of spacer sleeves;

a free end of said flexible strip extending outwardly through said gap from around said plurality of spacer tubes for engagement with the rivet setting tool.

2. A magazine for holding a quantity of blind rivets as set forth in claim 1, further comprising:

means for operably connecting said magazine to the rivet setting tool whereby said magazine rotates about a central axis thereof as said flexible strip and said rivets are drawn from said spool for use.

3. A magazine for holding a quantity of blind rivets as set forth in claim 2, further comprising:

bias means for adjusting resistance to rotation of said magazine.

4. A magazine for holding a quantity of blind rivets as set forth in claim 1, further comprising:

means for operably connecting said magazine to the rivet setting tool whereby said magazine rotates about a central axis thereof as said flexible strip and said rivets are drawn from said spool for use.

5. A magazine for holding a quantity of blind rivets as set forth in claim 2, further comprising:

bias means for adjusting resistance to rotation of said magazine.

6. A magazine for holding a quantity of blind rivets ready for use in an automatic rivet setting tool, said quantity of rivets connected in spaced relation along the length of an elongated strip of thin flexible material by having a distal portion of each rivet inserted therethrough said magazine comprising:

a plurality of parallel elongated spacer sleeves connected in evenly spaced arrangement between a pair of spaced parallel end plates forming a spool;

said quantity of rivets carried on said flexible strip being generally radially positioned with respect to a central axis of said spool with each rivet mandrel of each rivet of said quantity of rivets positioned between two adjacent spacer sleeves of said plurality of spacer sleeves, a head of each said rivet being positioned inwardly toward and adjacent said central axis when said flexible strip is wound in spiral fashion around said plurality of spacer sleeves;

means for operably connecting said magazine to the rivet setting tool whereby said magazine rotates about a central axis thereof as said flexible strip and said rivets are drawn from said spool for use.

7. A magazine for holding a quantity of blind rivets as set forth in claim 4, further comprising:

bias means for adjusting resistance to rotation of said magazine.

8. A magazine for holding a quantity of blind rivets ready for automatic feed into a rivet setting tool having a rivet table with a transverse rivet feed slot formed therethrough, said quantity of rivets connected in spaced relation along the length of an elongated strip of thin flexible material by having a distal portion of each rivet inserted therethrough said magazine comprising:

a cover having a bottom and a continuous cylindrical side wall extending from said bottom to define a generally circular open end of said cover;

a plurality of parallel elongated spacer sleeves connected in evenly spaced arrangement between a pair of spaced parallel end plates forming a spool;

said spool removably connected concentrically within said cover and having a first end plate of said pair of end plates positioned immediately adjacent said cap bottom and a second end plate of said pair of end plates positioned beyond said opening forming a gap between said second end plate and said opening, said gap having a width generally at least equal to the width of said flexible strip;

said quantity of rivets carried on said flexible strip being generally radially positioned within said cover with each rivet mandrel of each rivet of said quantity of rivets between two adjacent spacer sleeves of said plurality of spacer sleeves, the head of each rivet being positioned inwardly toward and adjacent a central axis of said spool when said flexible strip is wound in spiral fashion around said plurality of spacer sleeves;

a free end of said flexible strip extending outwardly through said gap from around said plurality of spacer tubes for engagement with the rivet table of the rivet setting tool.

9. A magazine for holding a quantity of blind rivets ready for automatic feed into a rivet setting tool having a rivet table with a transverse feed slot formed therethrough, said plurality of rivets connected in spaced relation along the length of an elongated strip of thin flexible material by having a distal portion of each rivet inserted therethrough said magazine comprising:

a plurality of parallel elongated spacer sleeves connected in evenly spaced arrangement between a pair of spaced parallel end plates forming a spool;

said quantity of rivets carried on said flexible strip being generally radially positioned with respect to a central axis of said spool with each rivet mandrel of each rivet of said quantity of rivets positioned between two adjacent spacer sleeves of said plurality of spacer sleeves, a head of each said rivet being positioned inwardly toward and adjacent said central axis when said flexible strip is wound in spiral fashion around said plurality of spacer sleeves;

means for operably connecting said magazine to the rivet setting tool whereby said magazine rotates about a central axis thereof as said flexible strip and said rivets are drawn from said spool for use.

10. A magazine for holding a quantity of blind rivets as set forth in claim 4, further comprising:

bias means for adjusting resistance to rotation of said magazine.

* * * * *

UNITED STATES PATENT AND TRADEMARK OFFICE

CERTIFICATE OF CORRECTION

PATENT NO. : 5,184,497

DATED : February 9, 1993

INVENTOR(S) : Hanlon et al.

It is certified that error appears in the above-identified patent and that said Letters Patent is hereby corrected as shown below:

Column 9, line 47, rewrite "4." as -- 7. --.
Column 9, line 48, rewrite "1," as -- 6, --.
Column 9, line 54, rewrite "2," as -- 4, --.
Column 9, line 57, rewrite "6." as -- 4. --.
Column 10, line 11, rewrite "7." as -- 8. --.
Column 10, line 12, rewrite "4," as -- 7, --.
Column 10, line 15, rewrite "8." as -- 6. --.

Signed and Sealed this

Twenty-ninth Day of November, 1994

*Attest:*

Bruce Lehman

BRUCE LEHMAN

*Attesting Officer*

*Commissioner of Patents and Trademarks*